US005187829A

United States Patent [19]

Atkins

[11] Patent Number: 5,187,829

[45] Date of Patent: Feb. 23, 1993

[54] TOOTHBRUSH CONSTRUCTION

[76] Inventor: Marie B. Atkins, 7070 Goodwood Ave., Baton Rouge, La. 70806

[21] Appl. No.: 519,418

[22] Filed: May 4, 1990

[51] Int. Cl.[5] ..... A46B 9/04

[52] U.S. Cl. ..... 15/167.1; 15/143.1; D4/107; D4/125

[58] Field of Search ..... 15/106, 143 R, 167.1, 15/167.2, 145, 176.1, 176.6; D4/107, 124–126; D7/656; 248/110,111; 211/65

[56] References Cited

U.S. PATENT DOCUMENTS

| | | | |
|---|---|---|---|
| D. 109,472 | 3/1938 | Clarren . | |
| D. 112,663 | 12/1938 | Partridge | D4/125 |
| D. 128,681 | 8/1941 | Reinold | D4/107 |
| D. 155,669 | 10/1949 | Zandberg et al. | D4/107 |
| D. 209,574 | 12/1967 | Zandberg . | |
| D. 237,659 | 11/1975 | Meyer et al. | D4/107 |
| D. 242,507 | 11/1976 | Cohen et al. | D4/125 |
| D. 294,391 | 2/1988 | Woo | D7/656 |
| D. 301,937 | 7/1989 | Thompson | D4/104 |
| 878,486 | 4/1908 | Crowell . | |
| 2,274,971 | 8/1984 | Kelley et al. | D7/656 |
| 2,511,235 | 6/1950 | Arwood | 15/106 |
| 2,539,035 | 1/1951 | Scanlon et al. | 248/110 |
| 2,576,388 | 11/1951 | Claflin | 30/327 |
| 2,921,326 | 1/1960 | Lautmann | 15/167.1 |
| 3,067,446 | 12/1962 | McGauley | 15/143 |
| 4,457,039 | 7/1984 | Massari | 15/167 |
| 4,558,483 | 12/1985 | Noser | 15/167 |
| 4,592,109 | 6/1986 | Borea et al. | 15/172 |

FOREIGN PATENT DOCUMENTS

| | | | |
|---|---|---|---|
| 180027 | 12/1935 | Switzerland | 15/143 R |

*Primary Examiner*—Harvey C. Hornsby
*Assistant Examiner*—Mark Spisich
*Attorney, Agent, or Firm*—John F. Sieberth

[57] ABSTRACT

The handle of the toothbrush is in the general form of an animal (e.g., a quadriped) having its body supported when not in use in a generally horizontal position. The handle is manually encircled and grasped by the hand with the thumb extending under and around the lower part of the body and with the palm and fingers extending over and around the upper part of the body portion as in a fist. To facilitate such grasping by small children or manually impared persons, the head/neck portion or the front leg portion of the animal (or both) are positioned to be adjacent to the thumb and forefinger side of the hand of the user, and the rear leg portion and an optional tail portion of the animal are positioned to be adjacent to the fourth finger side of the hand of the user. The brush head of the toothbrush extends from an end of the handle. When the brush is not in use, it is adapted to rest on a flat surface with the bristles spaced from such surface. The device is adapted to motivate children to acquire and maintain desirable lifelong habits of good dental hygiene, it is easy for children to use, and it has enhanced sanitary features not found in the common types of toothbrushes presently available in the marketplace.

4 Claims, 10 Drawing Sheets

FIG. 15
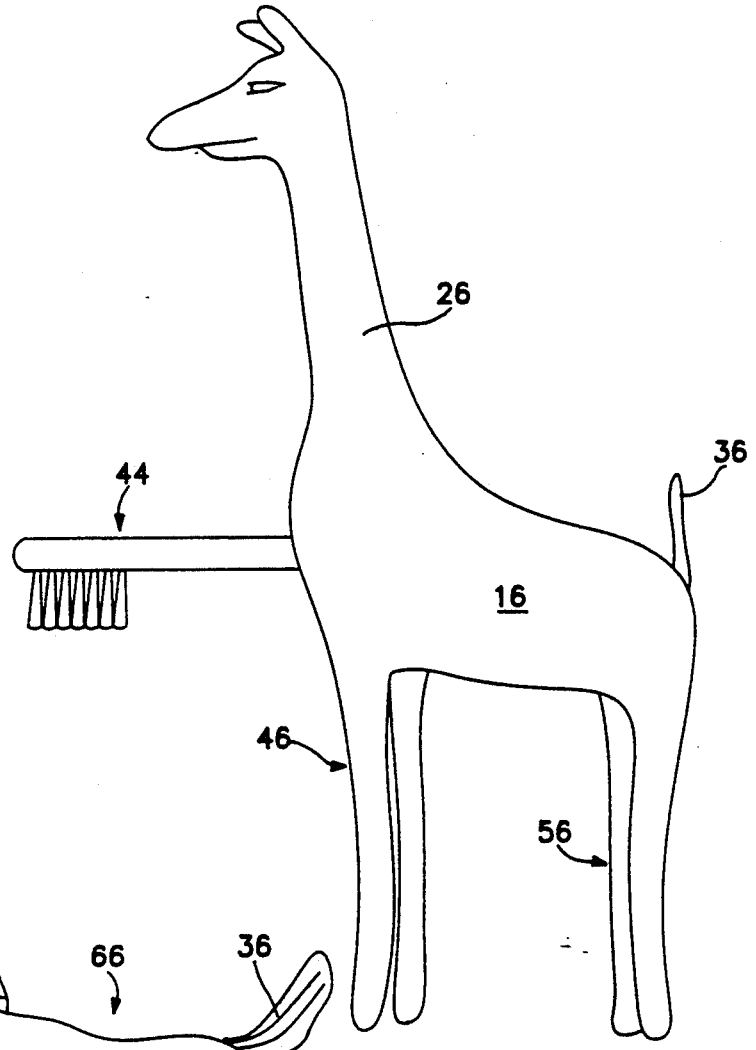
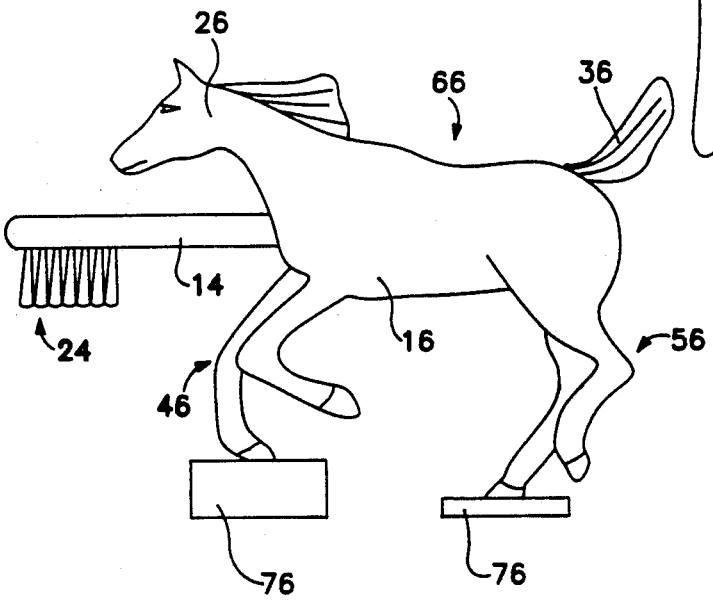
FIG. 16

TOOTHBRUSH CONSTRUCTION

TECHNICAL FIELD

This invention relates to improved toothbrush constructions of enhanced utility.

THE INVENTION

In accordance with this invention a toothbrush construction is provided which possesses a combination of functional and psychological advantages heretofore unavailable in the art. More particularly, this invention provides a toothbrush construction that is especially adapted to motivate children to acquire and maintain desirable lifelong habits of good dental hygiene. At the same time the toothbrush is exceptionally easy for children to use and this, in turn, reinforces its motivational aspects. And in addition to the foregoing combination of features, this invention provides a toothbrush construction having enhanced sanitary features not found in the common types of toothbrushes generally available in the present day marketplace.

Besides being of particular utility for children, the toothbrushes of this invention are especially suitable for use by handicapped persons, particularly persons deficient in manual dexterity.

The above and other advantages of this invention are achieved by providing a toothbrush construction which comprises:

(a) a handle portion; and (b) a brush head portion having bristles extending at an angle therefrom, said toothbrush construction being further characterized in that:

(c) said handle portion is in the general form of an animal and includes (i) a generally horizontal body (trunk) portion adapted to be manually encircled and grasped by the hand with the thumb extending under and around the lower part of the body portion and with the palm and fingers extending over and around the upper part of the body portion as in a fist, (ii) a head/neck portion attached to said body portion, (iii) a front leg portion attached to said body portion, (iv) a rear leg portion attached to said body portion, and (v) optionally, but preferably, a tail portion attached to said body portion;

(d) at least one of (ii) and (iii) extends outwardly relative to said body portion to form a first restraining member, and at least one of (iv) and (v) extends outwardly relative to said body portion to form a second restraining member spaced apart from the first restraining member;

(e) said restraining members are disposed on said handle portion such that when said body portion is grasped as in a fist as hereinbefore described, one of said restraining members is adapted to be proximate or adjacent to the thumb and forefinger side of the hand of the user and the other of said restraining members is adapted to be proximate or adjacent to the fourth finger side of the hand of the user;

(f) said brush head portion extends substantially longitudinally from an end of said handle portion; and (g) a portion of said handle portion is adapted to support the toothbrush, when not in use, on a flat supporting surface with the bristles of said brush head portion spaced from such supporting surface.

It will be seen, therefore, that when the brush is in use, (1) the handle portion is grasped around the body or trunk portion of the animal, (2) either a front leg portion or the head/neck portion, or the combination of both, serves as a lateral restraint for one edge of the clenched hand of the user, and (3) either a rear leg portion or the tail portion (if present), or the combination of both, serves as a lateral restraint for the other edge of the clenched hand of the user.

By "generally horizontal" is meant that the longitudinal axis of the body portion of the handle portion is either horizontal or is upwardly inclined from the horizontal by up to about 60 degrees. It will be understood that the word "trunk" is used to denote the major portion of the body or torso of the animal, not the trunk of an elephant.

Preferably, the brush head portion extends substantially longitudinally from the forward body portion of the animal. In this case, when the handle portion is grasped around the body or trunk portion of the animal, either a front leg portion or the head/neck portion, or the combination of both, serves as a lateral restraint for the thumb-forefinger edge or side of the clenched hand of the user, and either a rear leg portion or the tail portion (if present), or the combination of both, serves as a lateral restraint for the fourth finger edge or side of the clenched hand the user. However, the brush head portion can extend from the rearward portion of the body portion, and in this case, either a rear leg portion or the tail portion (if present), or the combination of both, serves as a lateral restraint for the thumb-forefinger edge or side of the clenched hand of the user, and either a front leg portion or the head/neck portion, or the combination of both, serves as a lateral restraint for the fourth finger edge or side of the clenched hand of the user.

If desired, the device can be equipped with two brush head portions, one extending longitudinally from the forward body portion of the animal and the other brush head portion extending from the rearward body portion of the animal.

As noted above, a portion of the handle portion is adapted to support the toothbrush, when not in use, on a flat supporting surface with the bristles of the brush head portion spaced from such supporting surface. For best results, the brush head portion should extend or project substantially horizontally from the handle portion, and in addition, should project forwardly and/or rearwardly from the body portion of the animal configured in the handle portion. In this way the bristles are not only kept from any contact with the underlying supporting surface when the brush is not in use, but in addition the user of the brush tends to be more inclined or induced to grasp the handle portion around the body portion rather than reaching for the brush head portion. These features in turn promote better sanitary conditions than often exist with conventional toothbrushes which are often grasped by the brush head in order to remove them from the brush holders which usually position the brush in a substantially upright or vertical position. And when such brush holders are configured in the form of slotted or apertured supports through which the handle of the conventional toothbrush is placed, the back portion of the bristles of the brush head actually rest on such support and this in itself can be an unsanitary condition.

The animal embodied in the handle portion can be configured in a prone position whereby the body of the animal and/or its folded limbs can serve as the portion of the handle adapted to support the toothbrush, when not in use, on a flat supporting surface with the bristles of the brush head portion spaced from such supporting surface. In such a case, the handle portion should include an outwardly extending head/neck portion and an outwardly extending tailportion to serve as the restraints for the thumb-forefinger and fourth finger edges or sides of the hand of the user.

In a preferred embodiment of this invention, the animal embodied in the construction of the handle portion is a quadripedal animal such that the front leg portion consists of two legs and the rear leg portion consists of two legs. Most preferably, the quadripedal animal is configured in a standing (or running) position with all four such legs extending in a generally downward direction relative to the body of the animal to thereby serve as the portion of the handle adapted to support the toothbrush, when not in use, on a flat supporting surface with the bristles of said brush head portion spaced from such supporting surface. By causing the leg portions to extend downwardly from the body or trunk of the quadripedal animal, a space is provided between the body or trunk and the underlying supporting surface thereby making it very easy to grasp the handle portion around the body or trunk of the animal. Thus in this preferred embodiment the leg portions serve both as supports for the overall device when not in use and as lateral restraining or support members on both sides or edges of the hand of the user when the device is in use. However, it is possible, though less preferred to have one or even two of the legs of the animal raised from the supporting surface. In this case is is desirable to provide a suitably large base below the legs that do rest upon the supporting surface so that when the brush is not in use the overall device is supported by the base with the bristles of said brush head portion spaced from such supporting surface, and preferably with the brush head portion disposed in a substantially horizontal position.

It is also preferred to position the brush head such that when the handle portion is grasped as in a fist as described above, and with the bristles extending toward the user in a tooth brushing position, none of the handle portion (including the leg portions, the head/neck portion, and the tail portion) is close enough to the user to interfere with the tooth brushing motion.

The brush head portion can be permanently attached or secured to the handle portion, or the brush head portion can be detachably attached or secured to the handle portion. In the latter case the brush head stem can be suitably grooved or otherwise shaped around its perimeter (e.g., as an octagon, a decagon, or etc.) so that it can be fitted tightly as with a snap fit into a matching recess within the handle portion and in a number of different angular orientations so that the orientation of the brush head and bristles can be altered to an optimum position for use by the particular user. In short the angular orientation of the brush head stem in the recess is, in this case, adjustable by the user.

Pursuant to a particularly preferred embodiment of this invention there is provided a toothbrush construction which comprises:

(a) a handle portion; and (b) a brush head portion having bristles extending at an angle therefrom, said toothbrush construction being further characterized in that:

(c) said handle portion is in the general form of a quadripedal animal and includes (i) a generally horizontal body (trunk) portion adapted to be manually encircled and grasped by the hand with the thumb extending under and around the lower part of the body portion and with the palm and fingers extending over and around the upper part of the body portion as in a fist, (ii) a head/neck portion attached to said body portion with at least a portion of said head/neck portion extending generally upwardly relative to said body portion, (iii) a front leg portion consisting of a pair of legs attached to said body portion with at least a portion of said pair of legs extending generally downwardly relative to said body portion, (iv) a rear leg portion consisting of a pair of legs attached to said body portion with at least a portion of said pair of legs extending generally downwardly relative to said body portion, and (v) a tail portion attached to said body portion with at least a portion of said tail portion extending generally upwardly relative to said body portion;

(d) said head/neck portion and said front leg portion are disposed on said handle portion such that when said body portion is grasped as in a fist as hereinbefore described, at least part of said head/neck portion and at least part of said front leg portion are adapted to abut or be proximate either to the thumb and forefinger side of the hand of the user or to the fourth finger side of the hand of the user;

(e) said tail portion and said rear leg portion are disposed on said handle portion such that when said body portion is grasped as in a fist as hereinbefore described, at least part of said tail portion and at least part of said rear leg portion are adapted to abut or be proximate either to the thumb and forefinger side of the hand of the user or to the fourth finger side of the hand of the user, whichever is not abutted by or proximate to at least part of said head/neck portion and at least part of said front leg portion;

(f) said brush head portion extends substantially longitudinally from an end of said handle portion; and (g) said front leg portion and said rear leg portion are adapted to support the toothbrush, when not in use, on a flat supporting surface with the bristles of said brush head portion spaced from such supporting surface.

The foregoing and other aspects, embodiments and features of this invention will be still further apparent from the ensuing description, appended claims and accompanying Drawings.

THE DRAWINGS

In the Drawings, in which like numerals represent like functional parts among the several embodiments depicted:

FIG. 15 is a side view of a typical toothbrush of this invention in which the animal is a giraffe;

FIG. 16 is a side view of a typical toothbrush of this invention in which the animal is a horse;

FURTHER DESCRIPTION

Figure 6:
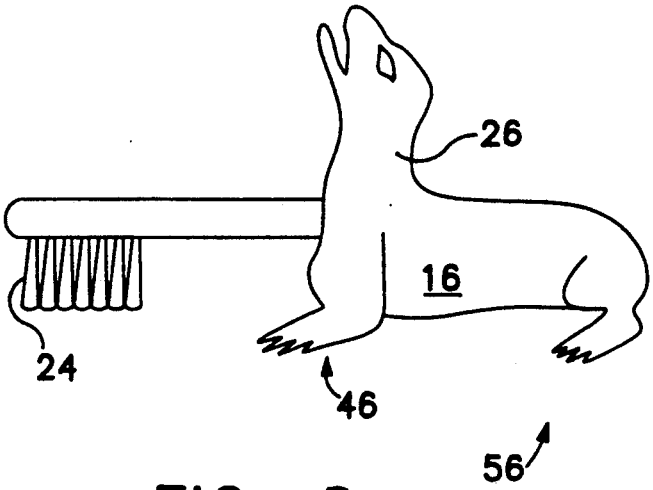
FIG. 6 is a side view of a typical toothbrush of this invention in which the animal is a seal.
Figure 7:
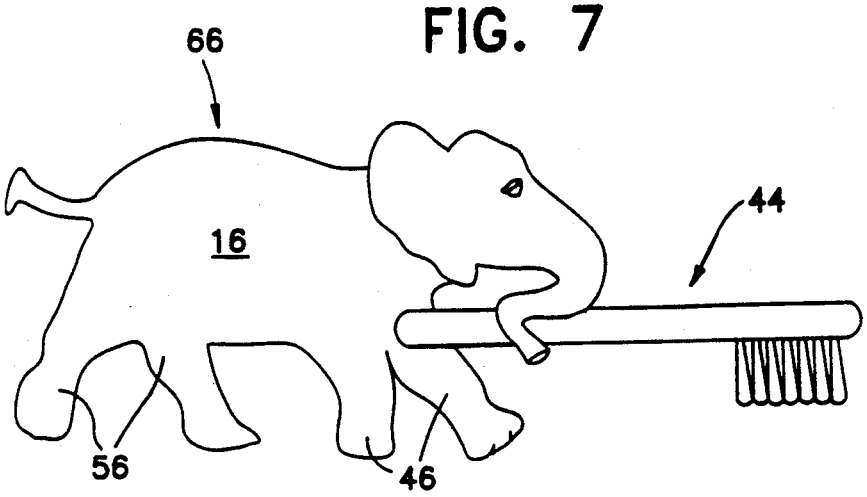
FIG. 7 is a side view of a typical toothbrush of this invention in which the animal is an elephant.
Figure 8:
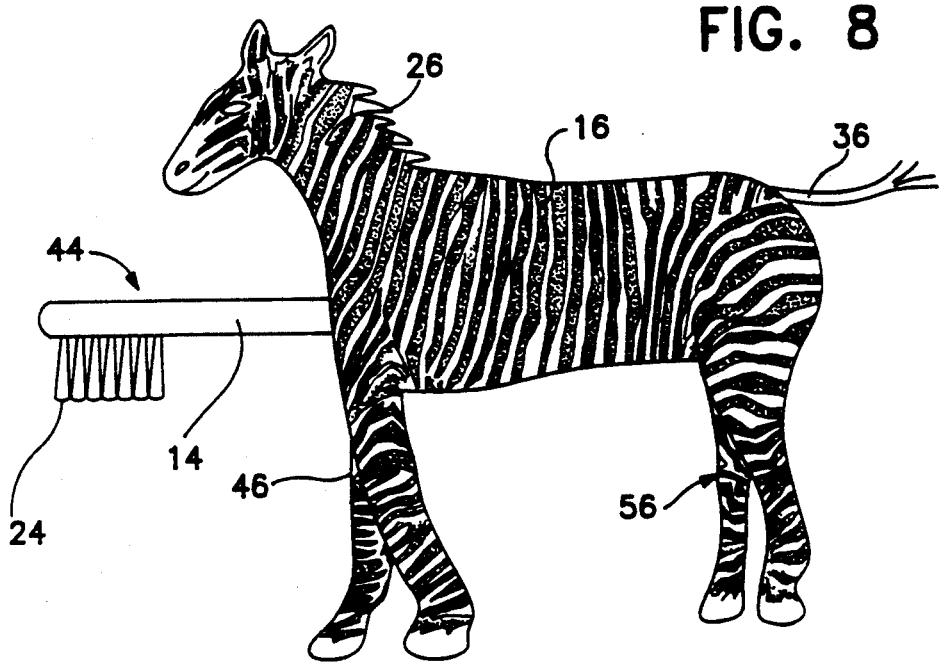
FIG. 8 is a side view of a typical toothbrush of this invention in which the animal is a zebra.
Figure 9:
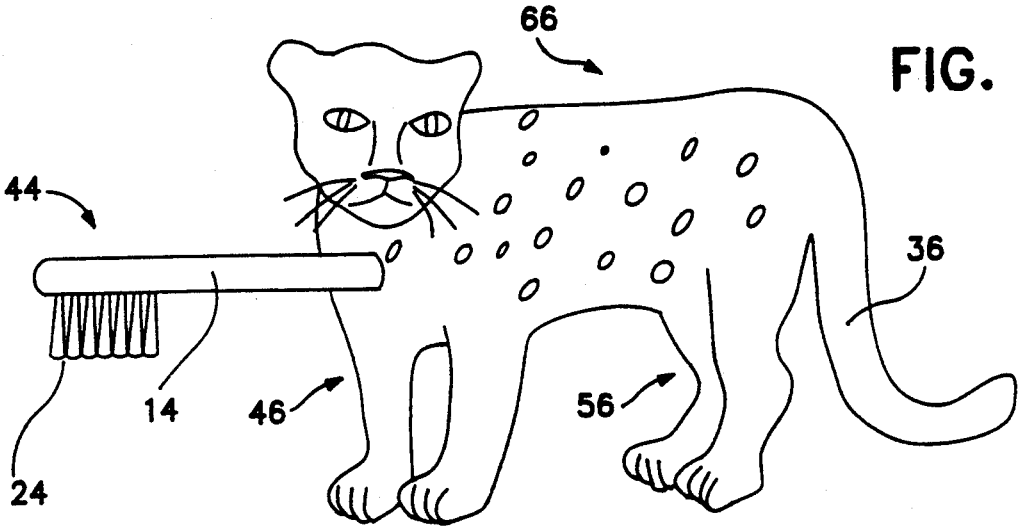
FIG. 9 is a side view of a typical toothbrush of this invention in which the animal is a jaguar.
Figure 17:
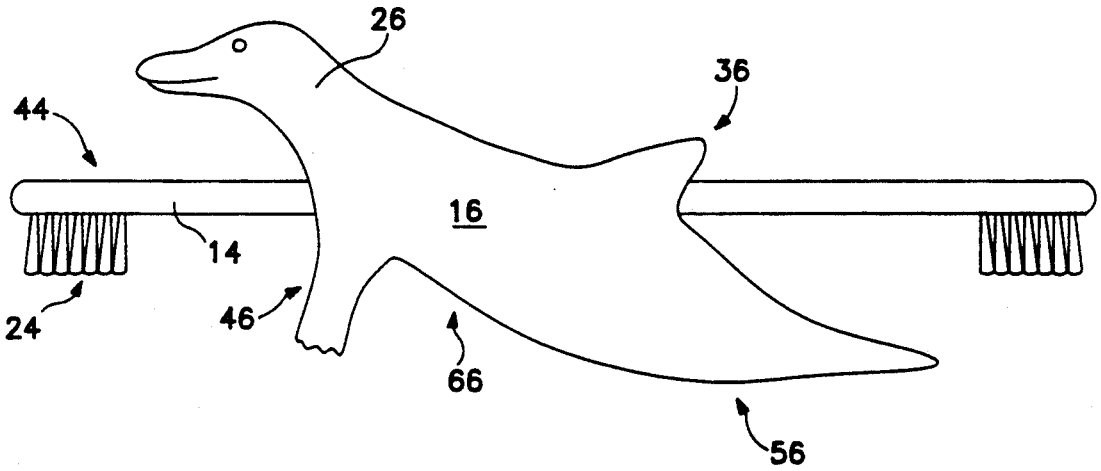
FIG. 17 is a side view of a typical toothbrush of this invention in which the animal is a dolphin.

It will be appreciated that the animal utilized in the design of the toothbrush need not be a land animal—it can be a fish or other underwater creature such as a squid or octopus, wherein fins, tentacles, claws or other body appendages serve as the leg and/or tail portions of the handle portion of the toothbrush construction. The seal and the dolphin utilized in the constructions depicted in FIGS. 6 and 17 illustrate such variant. It will also be appreciated that various other animals having a neck portion, leg portions and preferably a tail portion (or their equivalent) can be utilized in the design and construction of the toothbrushes of this invention, the forms depicted in the drawings being but exemplifications of some of the numerous types of animals that can be so utilized. It will also be appreciated that the form, shape, appearance and size of given animals can be stylized, distorted and/or exaggerated to achieve desired visual effects and to suitably arrange and position the functional elements of the device in the proper locations. Thus, for example, the animals can be given humanesque features and/or facial expressions to achieve humorous and/or other appealing characteristics, and the shapes or body portions of the animals can be elongated, shortened, widened, narrowed, etc, as needed to provide the proper hand gripping surface, the proper hand restraining members, the proper underlying support for the brush when not in use, and the proper support section for the brush head.

Among suitable quadripeds are the following animals: alligator, badger, bear, beaver, buffalo, bull, camel, caribou, cat, cheetah, cow, coyote, crocodile, deer, dog, donkey, elephant, elk, fox, giraffe, goat, hamster, hog, horse, iguana, impala, jaguar, koala, kudu, lemming, lemur, leopard, lion, llama, mongoose, moose, mountain lion, mouse, nutria, otter, ox, panther, pig, platypus, rabbit, raccoon, reindeer, rhinoceros, sheep, shrew, skunk, squirrel, steer, Tasmanian devil, tiger, wapiti, weasel, wolf, wolverine, yak, zebra, and the like, including diminutive forms such as calf, colt, cub, kitten, lamb, pony, puppy, and so on. Also readily utilizable in the practice of this invention are tailed animals having four limbs such as baboons, kangaroos, monkeys, wallabies, and the like. The animals used in designing the handle portion of the toothbrushes of this invention can also comprise prehistoric or extinct animals or reptiles such as the numerous species making up the families of dinosaurs, including for example, brontosaurus, stegosaurus, triceratops, and tyrannosaurus rex, among many others. Use may also be made of land, sea or air creatures having bodily characteristics (fins, tail, wings, etc.) which can be utilized (in exaggerated form when necessary) as restraining members for either side of the clenched hand grasping the handle portion. A few such suitable or amenable creatures include dolphins, pterodactyls, sharks, turtles, threshers, walrus, whales, and many others.

In turning our attention now to the Drawings, it should be kept in mind that the Figures are presented in simple, substantially schematic form to illustrate the principles of this invention.

As can be seen from the Drawings, the toothbrush constructions in the forms depicted comprise a handle portion 66 and a brush head portion 44. Handle portion 66 comprises a body portion 16 of an animal, a head/neck portion 26 of the animal, a tail portion 36 of the animal, a front leg portion 46 of the animal, and a rear leg portion 56 of the animal. The front leg portion 46 and the rear leg portion 56 are each usually (but not necessarily) composed of two laterally disposed limbs or their equivalent such as fins or flippers (note FIGS. 6 and 17). Brush head portion 44 comprises stem 14 and a plurality of bristles 24 (usually but not necessarily arranged in tufts) extending from the head end portion of stem 14 (usually but not necessarily extending at right angles from the stem). The plurality of bristles 24 form the brush for cleaning the teeth.

In use, the device in the form depicted is manually grasped around body portion 16 with the thumb extending under and around the underside of body portion 16 close to or immediately adjacent the back sides of front leg portion 46 and with the palm and four fingers (considered collectively) extending over and around the upper side of body portion 16. When so-grasped, as in a fist, head/neck portion 26 abuts or is close to the index finger side of the hand, whereas tail portion 36 and rear leg portion 56 abut or are close to the fourth finger side of the hand. Thus, front leg portion 46, head/neck portion 26, tail portion 36 and rear leg portion 56 mutually cooperate to restrain, or at least restrict or confine, lateral movement or slippage of the hand either toward or away from brush head portion 44.

It will be seen that stem 14 positions the brush composed of bristles 24 sufficiently remote from the outwardly projecting parts of handle portion 66 (i.e., head/neck portion 26, tail portion 36, front leg portion 46 and rear leg portion 56) such that such outwardly projecting parts do not and cannot interfere with the brushing action.

Figure 1:
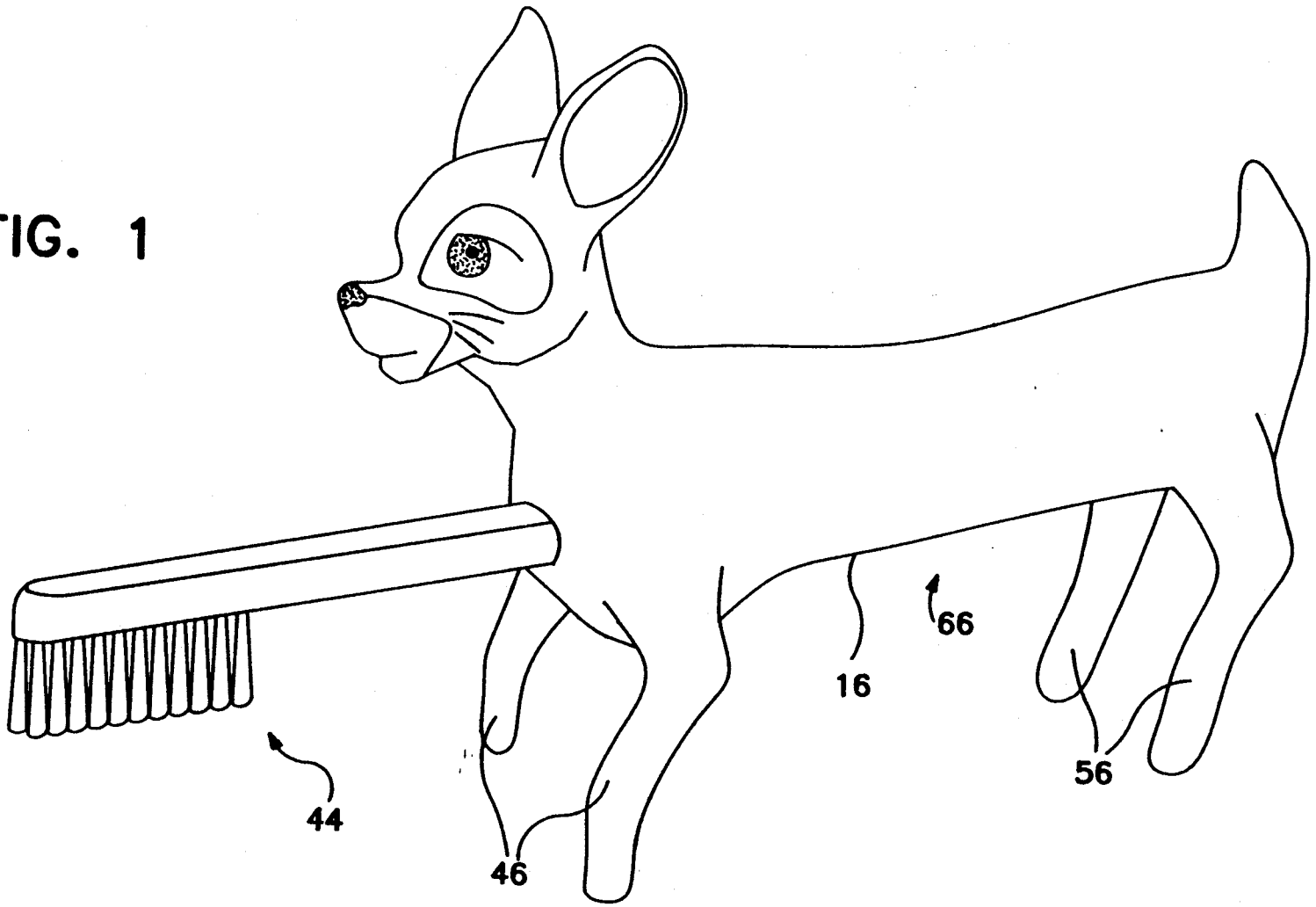
FIG. 1 is a view in perspective of a typical toothbrush of this invention in which the animal is a deer.
Figure 2:
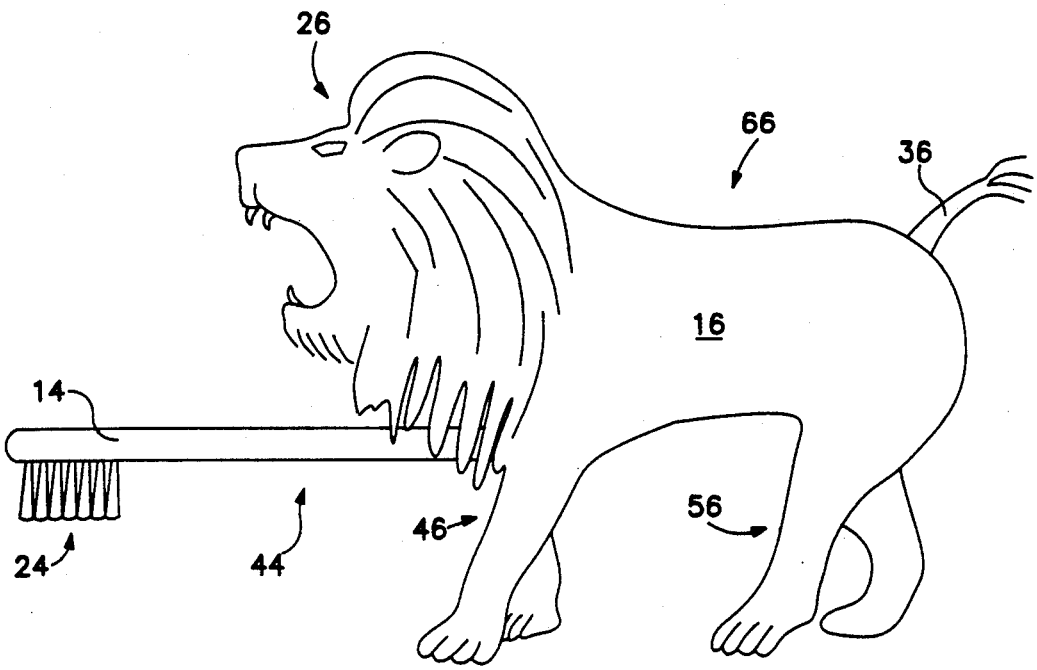
FIG. 2 is a side view of a typical toothbrush of this invention in which the animal is a lion.
Figure 3:
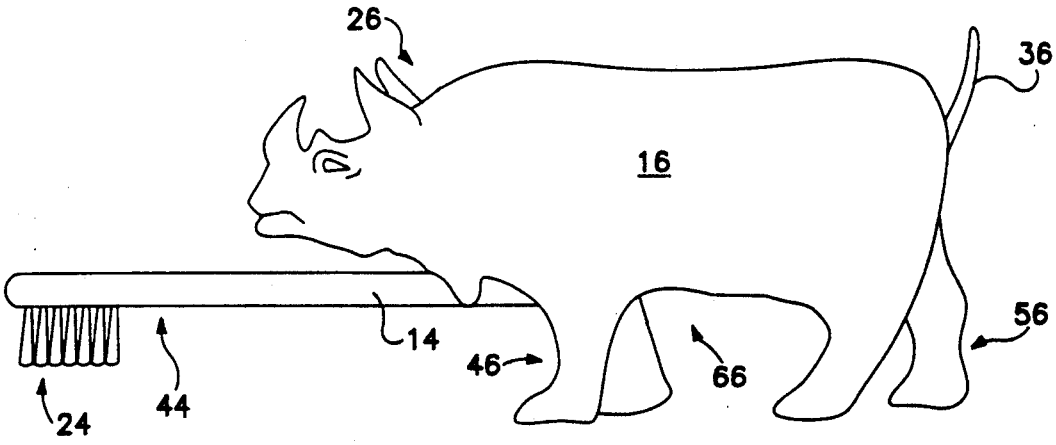
FIG. 3 is a side view of a typical toothbrush of this invention in which the animal is a rhinoceros.
Figure 4:
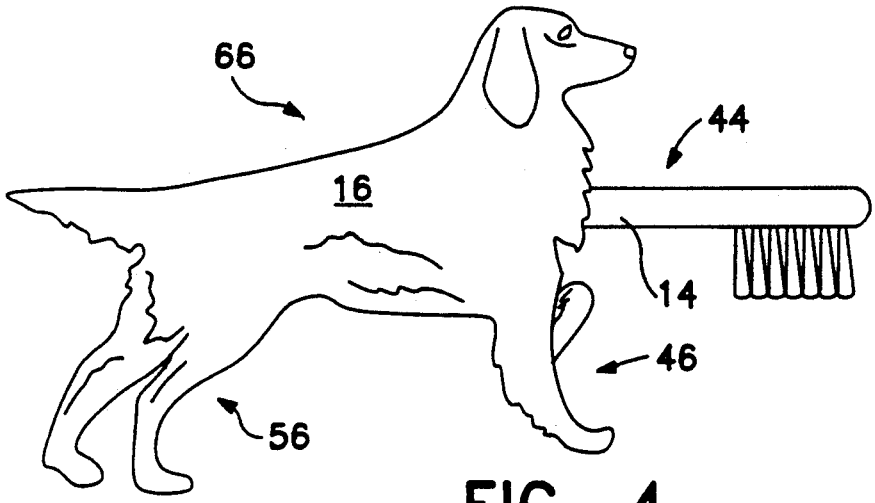
FIG. 4 is a side view of a typical toothbrush of this invention in which the animal is a dog.
Figure 5:
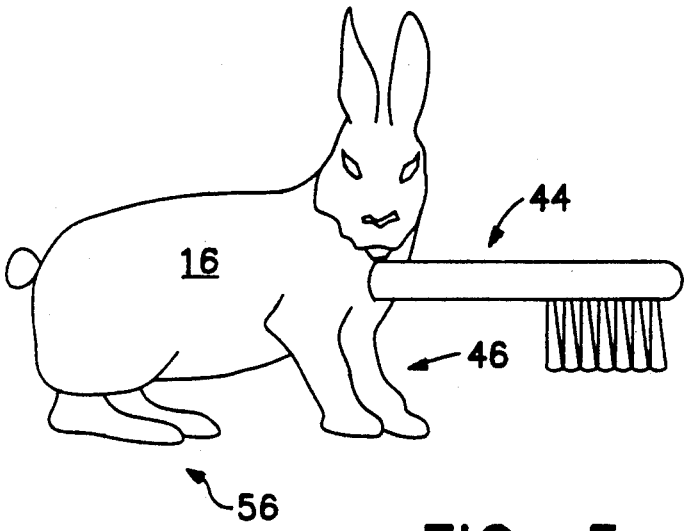
FIG. 5 is a side view of a typical toothbrush of this invention in which the animal is a rabbit.
Figure 10:
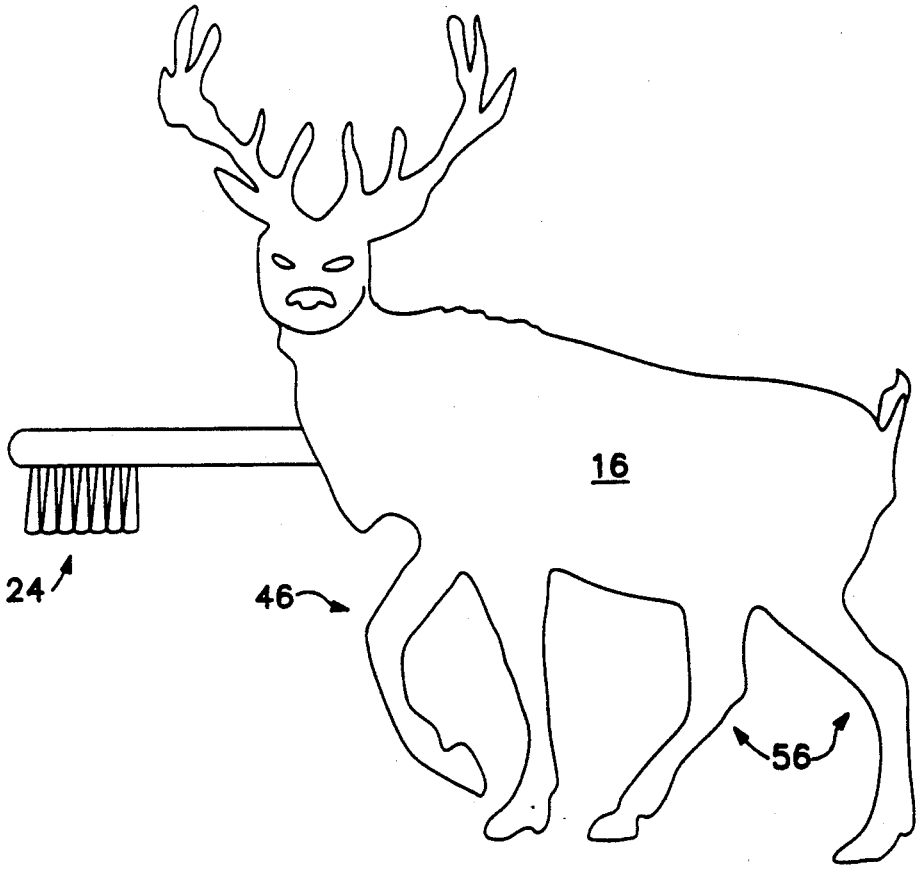
FIG. 10 is a side view of a typical toothbrush of this invention in which the animal is an elk.
Figure 11:
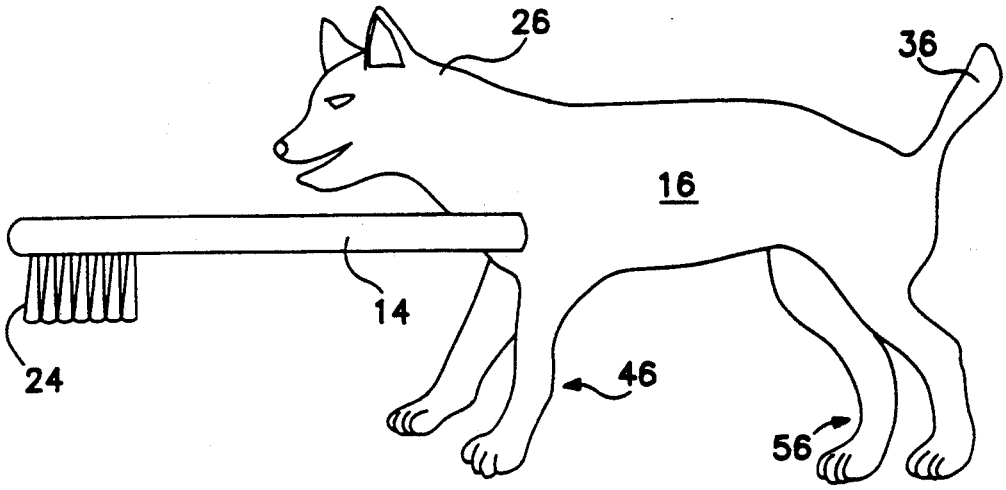
FIG. 11 is a side view of a typical toothbrush of this invention in which the animal is a wolf.
Figure 12:
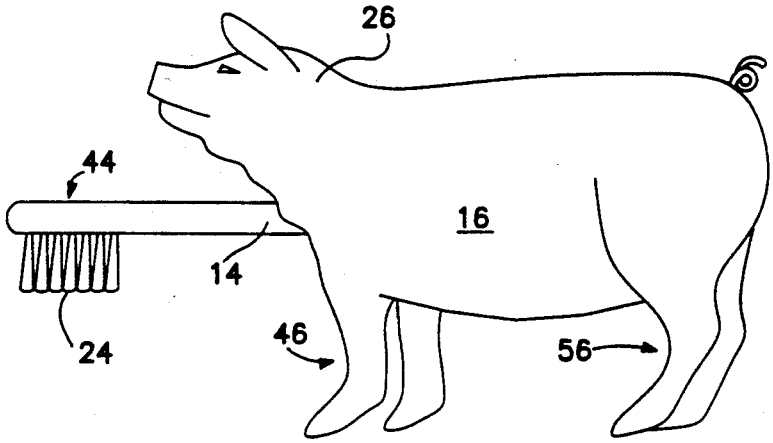
FIG. 12 is a side view of a typical toothbrush of this invention in which the animal is a pig.
Figure 13:
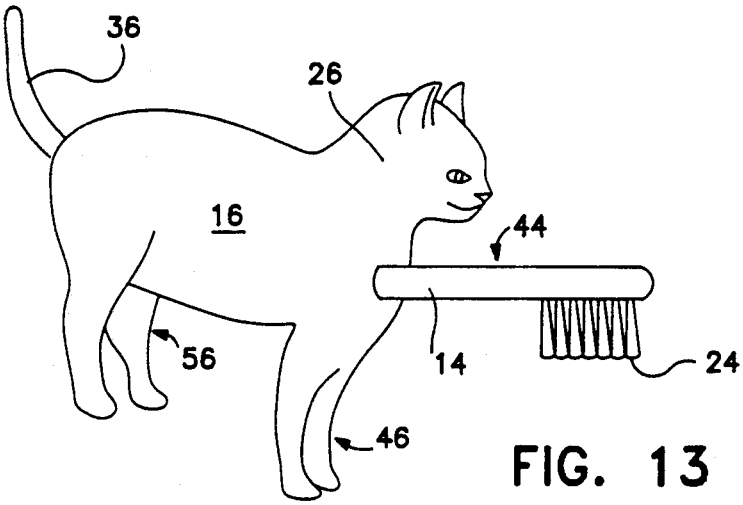
FIG. 13 is a side view of a typical toothbrush of this invention in which the animal is a cat.
Figure 14:
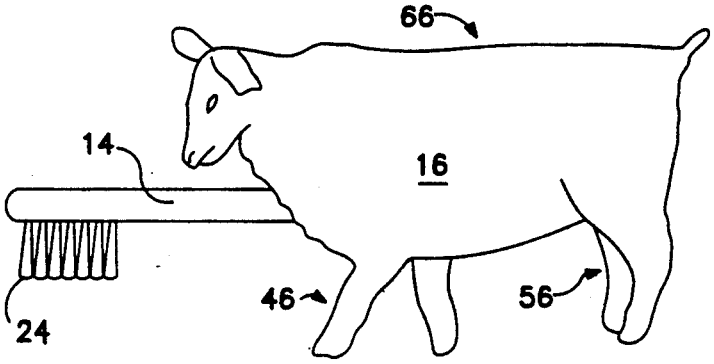
FIG. 14 is a side view of a typical toothbrush of this invention in which the animal is a sheep.

As FIGS. 4, 10 and 16 illustrate, all four legs of a quadriped need not be used as supports for the brush when not in use. In the case of FIGS. 4 and 10, three of the four limbs are used as such supports and in this case the overall construction is shaped and its weight is distributed such that the brush is readily balanced in a stable position on the three limbs resting on the underlying surface. The construction illustrated in FIG. 16 involves use of a pair of transversely disposed base plates 76, 76 such that one front limb is connected to one base plate and one back limb is connected to the other base plate to thereby provide a stable balanced support for the construction when not in use.

Figure 19:
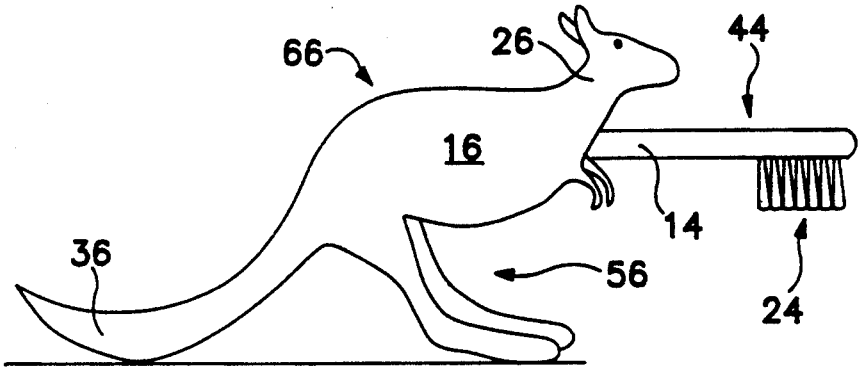
FIG. 19 is a side view of a typical toothbrush of this invention in which the animal is a kangaroo.
Figure 20:
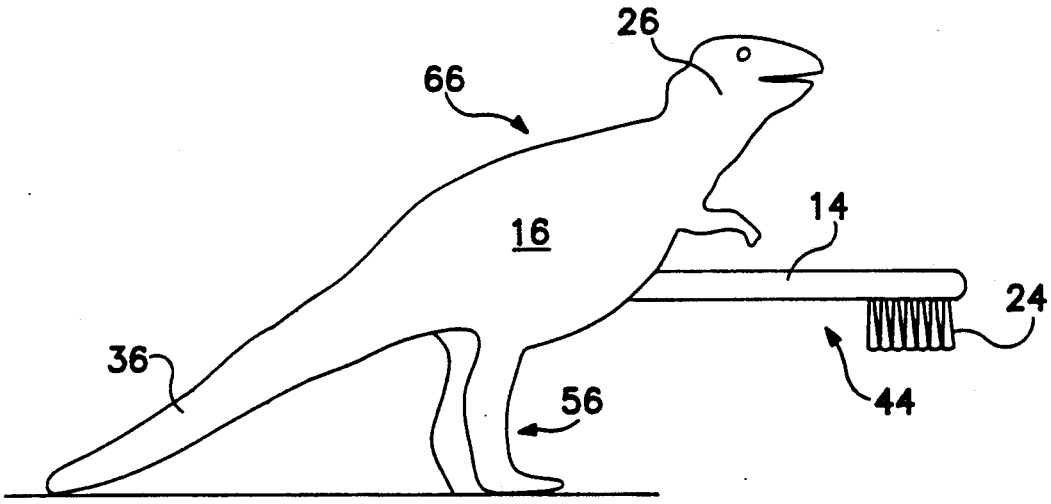
FIG. 20 is a side view of a typical toothbrush of this invention in which the animal is a dinosaur.
Figure 21:
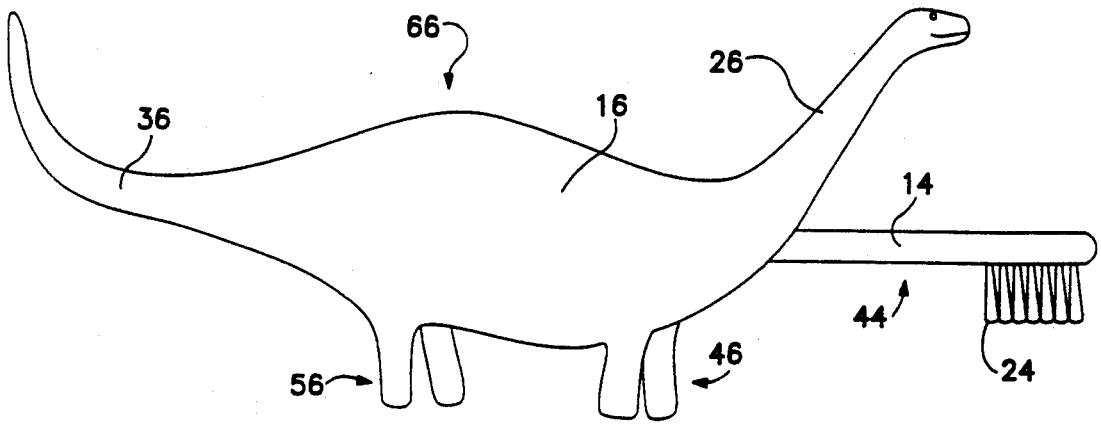
FIG. 21 is a side view of a typical toothbrush of this invention in which the animal is a dinosaur.

FIGS. 19 and 20 illustrate another variant which can be effectively utilized in the practice of this invention, namely the employment of the tail portion 36 and a leg portion composed of two laterally disposed limbs (usually rear leg portion 56) as the supports for the brush construction when not in use. Such construction serves as a tripod to provide such support for the brush on the underlying support.

Figure 18:
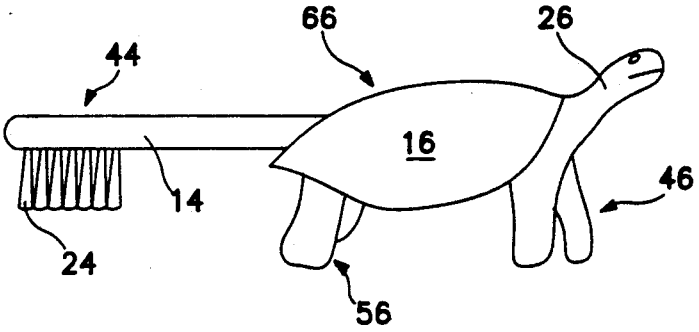
FIG. 18 is a side view of a typical toothbrush of this invention in which the animal is a turtle.

FIG. 17 illustrates a brush construction of this invention wherein two brush head portions 44, 44 are employed, one projecting from the front end and the other projecting from the back end of body portion 16 of the animal embodied in the construction of handle portion 66. In the embodiment depicted in FIG. 18, brush head portion 44 projects from the back end of body portion 16 whereas in most of the other figures it projects from the front end of the body portion.

Figure 22:
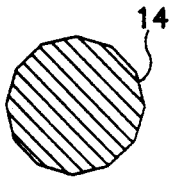
FIG. 22 is a cross-section of a preferred stem of the brush head portion of a toothbrush of this invention.
Figure 23:
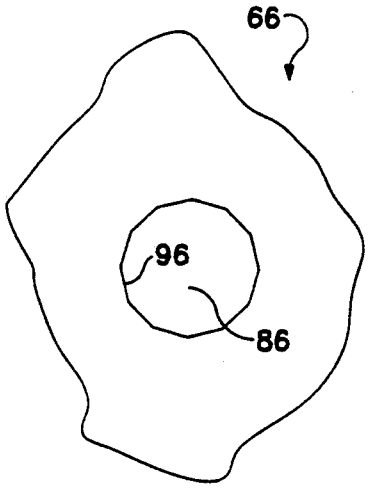
FIG. 23 is a front fragmental view of a preferred handle portion of a toothbrush of this invention.

As noted hereinabove, stem 14 of brush head portion 44 can be shaped to snugly fit into a matched recess or socket in handle portion 66 so that the entire brush head portion 44 is detachably attachable to the handle portion. One preferred way of accomplishing this is depicted in FIGS. 22 and 23. In the form depicted, stem 14 in FIG. 22 has a polygonal (in particular, a dodecagonal) shape in cross section. The fragment of handle portion 66 depicted in FIG. 23 has a matching recess or socket 86 defined by wall 96 which is likewise in polygonal form (in this case, dodecagonal form) so that recess 86 is adapted to snugly receive the stem 14. Such construction not only enables replacement of the brush head, but enables the user to orient the direction of the bristles relative to the handle portion by rotating the brush head to the desired orientation before inserting the stem into the matching recess or socket.

It will thus be appreciated that the devices of this invention can be adapted for use by right-handed persons or for left-handed persons simply by suitably altering the orientation of the brush head and bristles relative to the handle portion.

If desired, handle portion 66 can contain a hollowed-out compartment for storage of a detachably attachable brush head portion 44. Such compartment can be fitted with a suitable cover, plug or lid to encase the entire brush head portion within the handle portion. In this way the entire toothbrush can be transported in disassembled form from place to place in a sanitary condition, and with minimal risk that the user (especially a child) will lose the brush head portion during camping trips or like excursions.

This invention is susceptible to considerable variation in its practice within the spirit and scope of the appended claims. Thus this invention is not intended to be limited by the specific exemplifications described hereinabove.

What is claimed is:

1. A toothbrush construction which comprises:

(a) a handle portion; and (b) a brush head portion having bristles extending at an angle therefrom, said toothbrush construction being further characterized in that:

(c) said handle portion is in the form simulating an animal and includes (i) a generally horizontal body (trunk) portion which includes an upper part and a lower part, said body portion adapted to be manually encircled and grasped by the hand with the thumb extending under and around the lower part of the body portion and with the palm and finger extending over and around the upper part of the body portion as in a fist, (ii) a head/neck portion attached to said body portion, (iii) a front leg portion attached to said body portion, (iv) a rear leg portion attached to said body portion, and (v) a downwardly extending tail portion attached to said body portion;

(d) at least one of (ii) and (iii) extends outwardly relative to said body portion to form a first restraining member, and at least one of (iv) and (v) extends outwardly relative to said body portion to form a second restraining member spaced apart from the first restraining member;

(e) said restraining members are disposed on said handle portion such that when said body portion is grasped as in a fist as hereinbefore described, one of said restraining members is adapted to be proximate or adjacent to the thumb and forefinger side of the hand of the user and the other of said restraining members is adapted to be proximate or adjacent to the fourth finger side of the hand of the user;

(f) said brush head portion extends substantially longitudinally from said handle portion;

(g) said handle portion is adapted to support the toothbrush, when not in use, on a flat supporting surface with the bristles of said brush head portion remotely spaced from such supporting surface and with said body portion spaced from said flat supporting surface by a sufficient distance to enable the hand of the user to encircle and grasp said body portion between said restraining members with the thumb of said hand extending under and around the lower part of said body portion and with the palm and fingers of said hand extending over and around the upper part of said body portion as in a fist;

(h) said first restraining member and said second restraining member each extends outwardly relative to said body portion a sufficient distance to prevent the hand of the user from sliding over either of said restraining members while the hand of the user encircles and grasps said body portion between said restraining members with the thumb of said hand extending under and around the lower part of said body portion and with the palm and fingers of said hand extending over and around the upper part of said body portion as in a fist; and (i) said rear leg portion of the animal comprises a downwardly extending pair of limbs such that said portion of said handle portion adapted to support the toothbrush, when not in use, on a flat supporting surface is comprised of the downwardly extending pair of limbs and the downwardly extending tail portion to thereby provide three individual supports for the construction on such supporting surface, as in a tripod.

2. A construction as claimed in claim 1 wherein one said brush head portion extends substantially horizontally from a forward portion of said handle portion and wherein another said brush head portion extends substantially horizontally from a rearward portion of said handle portion.

3. A construction as claimed in claim 1 wherein said brush head portion extends substantially horizontally from said handle portion.

4. A construction as claimed in claim 1 wherein said brush head portion includes a stem and said handle portion includes a matching recess therein into which said stem can snugly fit such that said stem can be detachably attached to said handle portion with the brush head in a selected orientation relative to said handle portion.

* * * * *